US008985213B2

(12) United States Patent
Saini et al.

(10) Patent No.: US 8,985,213 B2
(45) Date of Patent: Mar. 24, 2015

(54) MICRO PROPPANTS FOR FAR FIELD STIMULATION

(75) Inventors: Rajesh Kumar Saini, Cypress, TX (US); Bradley L. Todd, Duncan, OK (US); Jimmie D. Weaver, Duncan, OK (US); James W. Ogle, Spring, TX (US); David Michael Loveless, Duncan, OK (US); Philip Nguyen, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 288 days.

(21) Appl. No.: 13/565,303

(22) Filed: Aug. 2, 2012

(65) Prior Publication Data

US 2014/0034309 A1 Feb. 6, 2014

(51) Int. Cl.
*E21B 43/267* (2006.01)
*E21B 43/26* (2006.01)

(52) U.S. Cl.
CPC ..... *E21B 43/267* (2013.01)
USPC ..... 166/308.1; 166/308.2; 166/308.5; 166/280.2; 166/280.1

(58) Field of Classification Search
CPC ..... E21B 43/267; E21B 43/06; C09K 8/62; C09K 8/68
USPC ..... 166/308.1, 308.2, 308.3, 308.4, 308.5, 166/280.2
See application file for complete search history.

(56) References Cited

U.S. PATENT DOCUMENTS 2,935,129 A * 5/1960 Allen et al. ..... 166/308.3
3,180,414 A * 4/1965 Parker ..... 166/281
4,460,627 A 7/1984 Weaver et al.
4,532,052 A 7/1985 Weaver et al.
5,095,987 A 3/1992 Weaver et al.
5,321,062 A 6/1994 Landrum et al.
5,381,864 A 1/1995 Nguyen et al.
5,492,178 A 2/1996 Nguyen et al.
5,559,086 A 9/1996 Dewprashad et al.
5,609,207 A 3/1997 Dewprashad et al.
5,921,317 A 7/1999 Dewprashad et al.
6,626,241 B2 9/2003 Nguyen
6,705,400 B1 3/2004 Nguyen et al.
6,725,926 B2 4/2004 Nguyen et al.
6,918,445 B2 7/2005 Todd et al.
6,945,329 B2 9/2005 Harris et al.
6,976,538 B2 12/2005 Wilson et al.
6,983,797 B2 1/2006 Nguyen et al.
6,997,259 B2 2/2006 Nguyen
7,032,664 B2 4/2006 Lord et al.
7,036,589 B2 5/2006 Nguyen
7,036,592 B2 5/2006 Nguyen et al.

(Continued)

FOREIGN PATENT DOCUMENTS

WO WO 2011/081549 7/2011

OTHER PUBLICATIONS

Authorized Officer Andre van Berlo, PCT International Search Report and Written Opinion of the International Searching Authority, PCT/US2013/053072, Oct. 9, 2014, 12 pages.

*Primary Examiner* — Zakiya W Bates
*Assistant Examiner* — Silvana Runyan
(74) *Attorney, Agent, or Firm* — Craig W. Roddy; Fish & Richardson P.C.

(57) ABSTRACT

A subterranean zone surrounding a well bore is fractured with a fracturing fluid. Micro proppant of 200 mesh or smaller is pumped into far field fractures of the subterranean zone and props the far field fractures open.

26 Claims, 2 Drawing Sheets

(56) References Cited

U.S. PATENT DOCUMENTS 7,040,403 B2 5/2006 Nguyen et al.
7,044,220 B2 5/2006 Nguyen et al.
7,044,224 B2 5/2006 Nguyen
7,059,406 B2 6/2006 Nguyen
7,063,150 B2 6/2006 Slabaugh et al.
7,063,151 B2 6/2006 Nguyen et al.
7,066,258 B2 6/2006 Justus et al.
7,073,581 B2 7/2006 Nguyen et al.
7,086,460 B2 8/2006 Nguyen et al.
7,093,658 B2 8/2006 Chatterji et al.
7,128,158 B2 10/2006 Nguyen et al.
7,178,596 B2 2/2007 Blauch et al.
7,198,681 B2 4/2007 Nguyen et al.
7,211,547 B2 5/2007 Nguyen
7,216,711 B2 5/2007 Nguyen et al.
7,228,904 B2 6/2007 Todd et al.
7,243,723 B2 7/2007 Surjaatmadja et al.
7,252,146 B2 8/2007 Slabaugh et al.
7,255,168 B2 8/2007 Nguyen et al.
7,258,170 B2 8/2007 Nguyen et al.
7,261,156 B2 8/2007 Nguyen et al.
7,264,051 B2 9/2007 Nguyen et al.
7,267,170 B2 9/2007 Mang et al.
7,271,133 B2 9/2007 Weaver et al.
7,281,581 B2 10/2007 Nguyen et al.
7,299,877 B2 11/2007 Welton et al.
7,308,939 B2 12/2007 Welton et al.
7,316,273 B2 1/2008 Nguyen
7,325,608 B2 2/2008 van Batenburg et al.
7,334,635 B2 2/2008 Nguyen
7,334,636 B2 2/2008 Nguyen
7,350,571 B2 4/2008 Nguyen et al.
7,353,876 B2 4/2008 Savery et al.
7,407,010 B2 8/2008 Rickman et al.
7,461,696 B2 * 12/2008 Nguyen et al. ..... 166/280.2
7,461,697 B2 12/2008 Todd et al.
7,500,519 B2 3/2009 Weaver et al.
7,541,318 B2 6/2009 Weaver et al.
7,571,767 B2 8/2009 Parker et al.
7,591,313 B2 9/2009 Weaver et al.
7,595,281 B2 9/2009 McDaniel et al.
7,662,756 B2 2/2010 Welton et al.
7,687,441 B2 3/2010 Hanes, Jr. et al.
7,690,431 B2 4/2010 Nguyen et al.
7,712,531 B2 5/2010 Nguyen et al.
7,723,264 B2 5/2010 McDaniel et al.
7,727,940 B2 6/2010 Reddy et al.
7,748,451 B2 7/2010 Welton et al.
7,799,744 B2 9/2010 Welton et al.
7,825,073 B2 11/2010 Welton et al.
7,882,894 B2 2/2011 Nguyen et al.
7,883,740 B2 2/2011 Nguyen et al.
7,900,702 B2 3/2011 Reddy et al.
7,923,417 B2 4/2011 Sanders et al.
7,926,591 B2 4/2011 Nguyen et al.
7,928,040 B2 4/2011 Sanders et al.
7,931,084 B2 4/2011 Nguyen et al.
7,946,345 B2 5/2011 Nguyen
7,963,330 B2 6/2011 Nguyen et al.
7,998,910 B2 8/2011 Todd
8,012,582 B2 9/2011 Luo et al.
8,017,561 B2 9/2011 Nguyen
8,076,271 B2 12/2011 Blauch et al.
8,082,992 B2 12/2011 Todd et al.
8,082,994 B2 12/2011 Nguyen et al.
8,097,566 B2 1/2012 Weaver et al.
8,113,283 B2 2/2012 Welton et al.
8,119,576 B2 2/2012 Reyes et al.
8,136,593 B2 3/2012 Weaver et al.
8,136,595 B2 3/2012 Weaver et al.
8,183,186 B2 5/2012 Luo et al.
8,188,013 B2 5/2012 Mang et al.
8,607,870 B2 12/2013 Gu et al.
8,613,314 B2 12/2013 Garcia-Lopez De Victoria et al.
2004/0018943 A1 * 1/2004 Pyecroft et al. ..... 507/100
2005/0194141 A1 * 9/2005 Sinclair et al. ..... 166/280.2
2007/0227732 A1 * 10/2007 Miller et al. ..... 166/281
2011/0015101 A1 1/2011 Robb et al.
2011/0030949 A1 2/2011 Weaver et al.
2011/0053810 A1 3/2011 Norman et al.
2011/0067875 A1 3/2011 Funkhouser et al.
2011/0071056 A1 3/2011 Saini et al.
2011/0120712 A1 5/2011 Todd et al.
2011/0120713 A1 5/2011 Todd et al.
2011/0166046 A1 7/2011 Weaver et al.
2011/0166049 A1 7/2011 Haggstrom et al.
2011/0214859 A1 9/2011 Loveless et al.
2011/0214860 A1 9/2011 Tonmukayakul et al.
2011/0214868 A1 9/2011 Funkhouser et al.
2011/0240291 A1 10/2011 Rickman et al.
2011/0240292 A1 10/2011 Dusterhoft et al.
2011/0240293 A1 10/2011 Lesko et al.
2011/0240296 A1 10/2011 Dusterhoft et al.
2011/0240297 A1 10/2011 Lord et al.
2011/0253374 A1 10/2011 Reyes et al.
2011/0257051 A1 10/2011 Welton et al.
2011/0269651 A1 11/2011 Bismarck et al.
2011/0269904 A1 11/2011 Bismarck et al.
2012/0000659 A1 1/2012 Loveless et al.
2012/0004148 A1 1/2012 Ogle et al.
2012/0012320 A1 1/2012 Weaver et al.
2012/0024530 A1 2/2012 Todd et al.
2012/0103616 A1 5/2012 Weaver et al.
2012/0152548 A1 * 6/2012 Hinkel et al. ..... 166/305.1
2012/0165232 A1 6/2012 Todd et al.
2012/0167803 A1 7/2012 Luo et al.
2012/0178652 A1 7/2012 Welton et al.
2012/0180551 A1 7/2012 Reyes et al.
2012/0181019 A1 7/2012 Saini et al.
2012/0181029 A1 7/2012 Saini et al.
2012/0181033 A1 7/2012 Saini et al.
2012/0183687 A1 7/2012 Nguyen et al.
2012/0189771 A1 7/2012 Saini et al.
2014/0262291 A1 9/2014 Chen et al.

* cited by examiner

MICRO PROPPANTS FOR FAR FIELD STIMULATION

BACKGROUND

In certain low permeability formations, such as shale, hydraulic fracturing stimulation is necessary to effectively produce fluids from the formation. A hydraulic fracturing stimulation in shale and similar formations not only forms primary fractures in the near field around the well bore, but also forms induced, dendritic fractures in the far field extending from the primary fractures. These induced, dendritic fractures are generally formed at the tip and edges of the primary fractures, and extend outwardly in a branching tree like manner from the primary fractures.

DESCRIPTION OF DRAWINGS

Like reference symbols in the various drawings indicate like elements.

DETAILED DESCRIPTION

Figure 1:
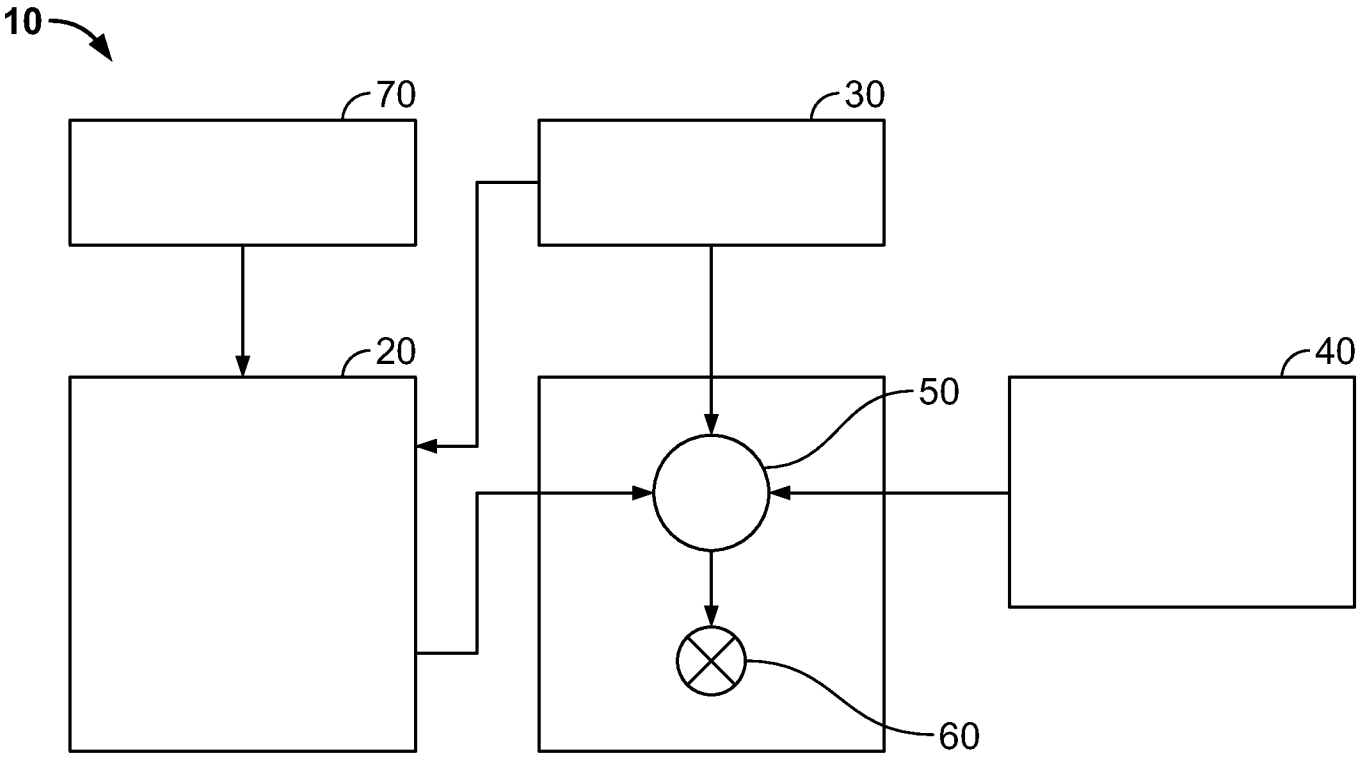
FIG. 1 is a schematic of a fracturing system for a well.

As mentioned above, in certain low permeability formations, hydraulic fracturing stimulation forms primary fractures in the near field around the well bore and induced, dendritic fractures in the far field. The dendritic fractures are generally formed at the tip and edge of the primary fractures, and extend outwardly in a branching tree like manner. Because these secondary, dendritic fractures can extend transversely to the trajectory of the primary fractures, they reach and link natural fractures both in and adjacent to the trajectory of the primary fractures. As such, they reach a larger portion of the naturally occurring fracture network, and link the natural fractures back to the primary fractures and to the well. Shale, coal and many other low permeability formations, for example formations having a permeability of approximately 1 millidarcy (mD) or less, are known to fracture in this manner.

The concepts herein encompass propping the induced, dendritic fractures and, in certain instances, the linked natural fractures, to potentially improve recovery from the formation. The induced, dendritic fractures are small. Typical proppants used in hydraulic fracturing stimulation, in the range of 100 to 12 mesh (149-1680 μm), cannot invade the dendritic fractures, and therefore, will not prop or keep the dendritic fractures open when hydraulic pressure from the fracturing treatment is withdrawn. Thus, micro proppants smaller than 100 mesh (149 μm), and in certain instances equal to or smaller than 200 mesh (74 μm), 230 mesh (63 μm) or even 325 mesh (44 μm), are used to prop open these induced, dendritic fractures. In certain instances, the size of the micro proppant can be selected in relation to the size of the dendritic fractures to be propped, such that the particle size is less than the transverse dimension of the dendritic fracture when held open under fracturing pressure.

FIG. 1 is one example of a fracture stimulation system 10 in accordance with the concepts herein. In certain instances, the system 10 includes a fracturing gel producing apparatus 20, a fluid source 30, a proppant source 40, and a pump and blender system 50 and resides at a surface well 60 site. In certain instances, the gel producing apparatus 20 combines a gel pre-cursor with fluid (e.g., liquid or substantially liquid) from fluid source 30, to produce a hydrated fracturing gel that is used as a fracturing fluid. The hydrated fracturing gel can be a gel for ready use in a fracture stimulation treatment of the well 60 or a gel concentrate to which additional fluid is added prior to use in a fracture stimulation of the well 60. In other instances, the fracturing gel producing apparatus 20 can be omitted and the fracturing fluid sourced directly from the fluid source 30. In certain instances, the fracturing fluid can include water, a hydrocarbon fluid, a polymer gel, foam, air, wet gases and/or other fluids.

The proppant source 40 can include a pre-made proppant for combination with the fracturing fluid and/or, as discussed in more detail below, the proppant source 40 can include a source of proppant pre-cursor. The proppant pre-cursor is a composition that generates the proppant after being combined with the fracturing fluid and/or while downhole (i.e., in the well bore and/or in the fractures of the subterranean zone). In certain instances, the proppant source 40 can additionally include a source of an activator for the proppant pre-cursor that activates the proppant pre-cursor to generate the proppant.

The system may also include various other additives 70 to alter the properties of the mixture. For example, the other additives 70 can be included to reduce pumping friction, to reduce or eliminate the mixture's reaction to the geological formation in which the well is formed, to operate as surfactants and/or to serve other functions.

The pump and blender system 50 receives the fracturing fluid and combines it with other components, including proppant or proppant pre-cursor (and in some instances, the activator) from the proppant source 40 and/or additional fluid from the additives 70. The resulting mixture may be pumped down the well 60 under pressure to fracture stimulate a subterranean zone (i.e., produce fractures), for example to enhance production of resources from the zone. In instances using an activator, the activator can be combined with the proppant pre-cursor at the pump and blender system 50 and/or injected down the well 60 at another time. Notably, in certain instances, different sources of fluids are valved to the pumping and blender system 50 so that the pumping and blender system 50 can source from one, some or all of the difference sources of fluid at a given time. Thus, for example, the pumping and blender system 50 can provide just fracturing fluid into the well at some times, just proppant pre-cursor and/or activator at other times, and combinations of the fluids at yet other times.

Figure 2:
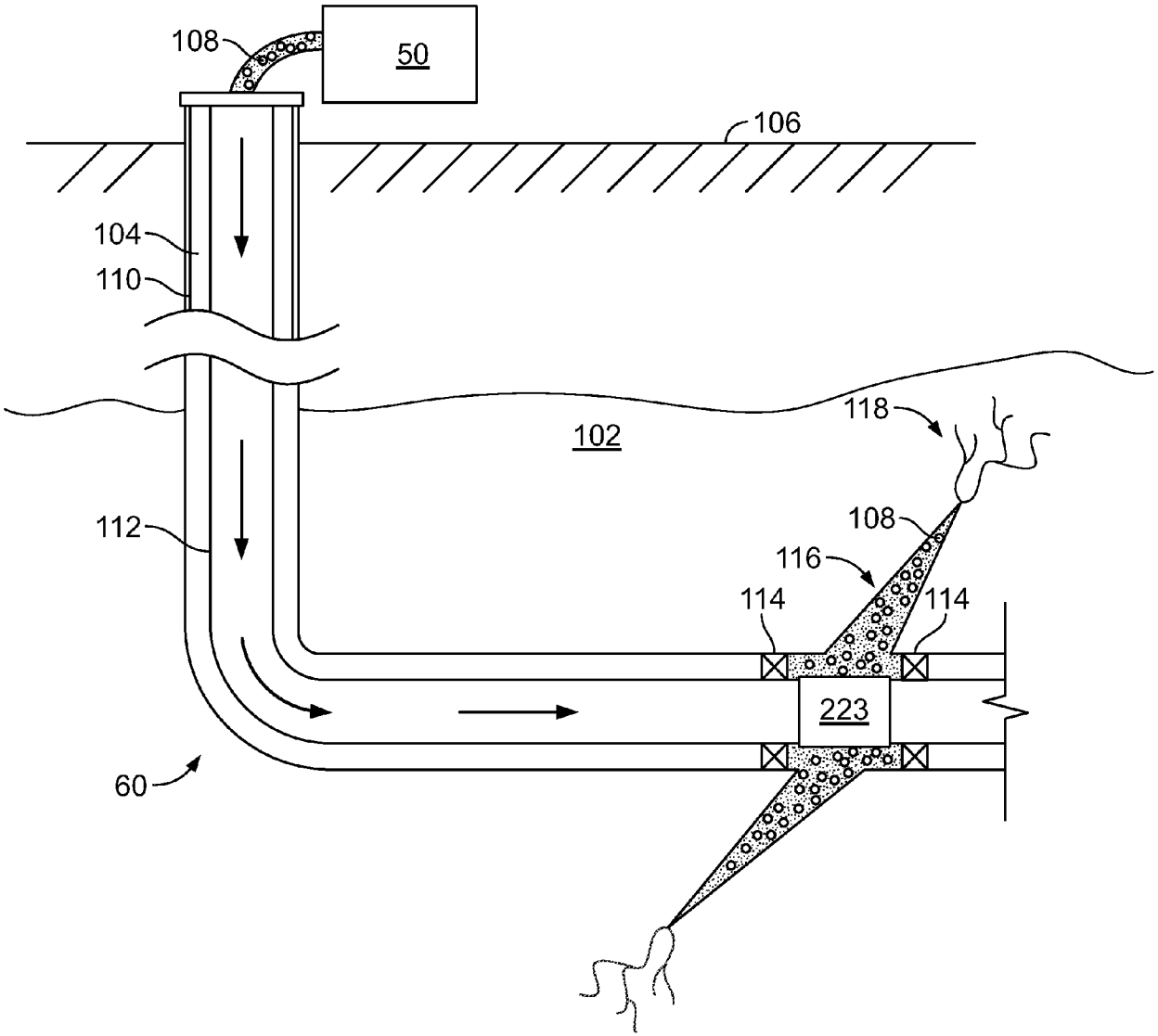
FIG. 2 is a schematic side view of a well system during a fracture treatment.

FIG. 2 shows the well 60 during a fracture treatment of a subterranean zone of interest 102 surrounding a well bore 104. The subterranean zone 102 can include one or more subterranean formations or a portion of a subterranean formation.

The well bore 104 extends from a terranean surface 106, and the fracturing fluid 108 is applied to the subterranean zone 102 surrounding the horizontal portion of the well bore. Although shown as vertical deviating to horizontal, the well bore 104 may include horizontal, vertical, slant, curved, and other types of well bore geometries and orientations, and the fracturing treatment may be applied to a subterranean zone surrounding any portion of the well bore. The well bore 104 can include a casing 110 that is cemented or otherwise secured to the well bore wall. The well bore 104 can be uncased or include uncased sections. Perforations can be formed in the casing 110 to allow fracturing fluids and/or other materials to flow into the subterranean zone 102. In cased wells, perforations can be formed using shape charges, a perforating gun, hydrojetting and/or other tools.

The well is shown with a work string 112 depending from the surface 106 into the well bore 104. The pump and blender system 60 is coupled a work string 112 to communicate the fracturing fluid 108 into the well bore 104. The working string 112 may include coiled tubing, jointed pipe, and/or other structures that communicate fluid through the well bore 104. The working string 112 can include flow control devices 223 (e.g., bypass valves, ports, and or other tools or well devices) that control a flow of fluid from the interior of the working string 112 into the subterranean zone 102. For example, the working string 112 may include ports adjacent the well bore wall to communicate the fracturing fluid 108 directly into the subterranean zone 102, and/or the working string 112 may include ports that are spaced apart from the well bore wall to communicate the fracturing fluid 108 into an annulus in the well bore between the working string 112 and the well bore wall.

The working string 112 and/or the well bore 104 includes one or more sets of packers 114 that seal the annulus between the working string 112 and well bore 104 to define an interval of the well bore 104 into which the fracturing fluid 108 will be pumped. FIG. 2 shows two packers 114, one defining an uphole boundary of the interval and one defining the downhole end of the interval.

The rock matrix of the subterranean zone 102 is of a type that when fractured, produces both a primary fracture 116 in the near field and secondary, induced, dendritic fractures 118 in the far field. The secondary fractures 118 have propagated from or near the ends and edges of the primary fracture 116. In certain instances, the subterranean zone 102 is a low permeability zone having a permeability of 1 mD or less. For example, the subterranean zone 102 can be shale. In certain instances, the rock matrix of the subterranean zone 102 may include cleating or natural fractures (i.e., those that existed prior to, and were not caused by, a fracture treatment). The natural fractures tend to run generally in a direction that is parallel to the primary fracture 116. The secondary fractures 118 run in many directions including directions non-parallel and, in certain instances, perpendicular to the direction of the primary fracture 116. As a result, the secondary fracture 118 can cross, and thereby link, the natural fractures to the primary fracture 116.

The fracturing treatment may be performed in one or more stages, where different amounts, sizes, and/or concentrations of proppant (including micro as well as larger proppant) or, in some stages, no proppant is provided into the fractures 116, 118. For example, in certain instances, the fractures 116, 118 can be initiated with a fracturing fluid containing little or no proppant, then subsequent stages can provide the proppant to the fractures 116, 118 in a manner that fills and props both the secondary fractures 118 and primary fractures 116 open. Given the small size of the dendritic, secondary fractures 118, one or more of the stages may introduce a micro proppant such that the particle size is less than the transverse dimension of the fracture when held open under fracturing pressure. In certain instances, the micro proppant is smaller than 100 mesh (149 μm), and in certain instances equal to or smaller than 200 mesh (74 μm), 230 mesh (63 μm) or even 325 mesh (44 μm). The stages provide proppant such that the secondary fractures 118 are propped by the micro proppant. Notably, the proppant is provided into the subterranean zone 102 at a concentration equal to or less than the critical bridging concentration of the micro proppant in the subterranean zone 102. In certain instances, the stages can additional provide proppant of larger than micro proppant to prop the primary fractures 116. The stages can be arranged to provide the proppant and micro proppant intermixed and/or some stages can provide substantially just micro proppant and other stages can provide just larger proppant.

The proppant source can provide proppant and/or proppant pre-cursor to the fracturing fluid. In the instance of proppant pre-cursor, the proppant can subsequently be generated in the fracturing fluid. For example, the proppant can be generated in the fracturing fluid at the surface and/or in the well bore 104, and in certain instances, in the primary fractures 116 and/or secondary fractures 118 of the subterranean zone 102. The proppant can take many forms, as described below. Notably, although many examples of micro proppant are discussed below as capable of being formed downhole, it is also within the concepts herein to pre-form these micro proppants at the surface and provide them as proppant to the fracturing fluid or to form them in the fracturing fluid at the surface prior to pumping the fracturing fluid into the well bore 104.

In certain instances, micro proppant in the form of silicate particulate can be generated downhole (i.e., in the well bore 104 and/or in the fractures of the subterranean zone 102) by providing a proppant pre-cursor of organic silicate at neutral pH into the well bore 104 along with the fracturing fluid. In certain instances, the organic silicate can be tetraethylorthosilicate (TEOS) and/or other organic silicates. Once in the well bore 104, the pH of the fracturing fluid is changed to either basic or acidic to hydrolyze the organic silicate. The pH can be changed by introducing an activator such as by injecting an acid or base fluid into the well bore 104, by injecting a slow dissolving pH changing material with the fracturing fluid, and/or in another manner. On hydrolysis, the organic silicate will form a gel which will eventually turn into small particles. The concentration of organic silicate in the fracturing fluid drives the particle size, and concentrations can be selected to produce micro proppant. Notably, micro proppant can be generated in this manner in situations where oil is used for the fracturing fluid (e.g. gas wells and/or other types of wells). For example, the organic silicate can be emulsified to form a microemulsion in the oil fracturing fluid. On contacting with formation water and changing the pH, the organic silicate will hydrolyze and will generate micro proppant.

In certain instances, micro proppant in the form of alumina particles can be generated downhole by providing a proppant pre-cursor of organic acid aluminoxane into the well bore 104 along with the fracturing fluid. The organic acid aluminoxane will hydrolyze slowly to generate alumina particles as micro proppant. The aluminoxane can be tailored to hydrolyze fast or slow depending on the requirements of the fracture treatment, and can be tailored to promote formation of the micro proppant in the secondary fractures 118.

In certain instances, micro proppant in the form of calcium carbonate ($CaCO_3$) and barium sulfate ($BaSO_4$) can be generated downhole. For example, $CaCO_3$ can be generated by providing a proppant pre-cursor of calcium oxide (CaO) into the well bore 104 along with the fracturing fluid in a very low concentration, and then additionally and/or subsequently providing an activator of an aqueous fluid containing carbon dioxide ($CO_2$) into the well bore 104. The CaO will react with water to form $Ca(OH)_2$ which in turn reacts with the $CO_2$ to form $CaCO_3$ and precipitate as micro proppant. To prevent aggregation of particles, surfactant can be added to the fracturing fluid or in connection with the activator. In another example, $BaSO_4$ can be generated by providing a proppant pre-cursor of barium carbonate ($BaCO_3$) in the fracturing fluid in a very low concentration, and additionally and/or subsequently providing an activator of aqueous sulfuric acid ($H_2SO_4$) into the well bore 104. The resulting reaction will form the $BaSO_4$ which will precipitate as micro proppant suspended in the solution.

In certain instances, micro proppant in the form of a polymer can be generated downhole. The micro proppant can be generated by free radical polymerization of a monomer with a cross linker. For example, a monomer along with a crosslinker is emulsified in water and provided as a proppant pre-cursor into the well bore 104 along with the fracturing fluid and/or emulsified directly in the fracturing fluid. The emulsification can be performed with a surfactant. Polymerization of the monomer is initiated downhole by heat of the subterranean zone 102 and/or by an activator that is included in the microemulsion to form micro proppant.

In one example, styrene along with small amount (1-3%) of 4-vinylstyrene can be emulsified in water and/or the fracturing fluid with the aid of a surfactant to form a microemulsion. Oil soluble azo-initiators are included in the emulsion to start polymerization of styrene as the temperature increases, such as due to heat of the subterranean zone 102, to generate micro proppant. The amount of crosslinker in the emulsion determines the hardness, and thus the hardness of the micro proppant can be tailored for various pressure ranges.

Another way to form the micro proppant is by forming thermosetting particles downhole. In one example, furfural is emulsified in water and provided as a proppant pre-cursor into the well bore 104 along with the fracturing fluid and/or emulsified directly in the fracturing fluid. The emulsification can be performed with a surfactant. An acid as an activator can be introduced downhole by injecting an acid fluid into the well bore 104, by injecting a slow dissolving acid generating material with the fracturing fluid or separately, and/or in another manner. The acid will initiate formation of furan resin particles as micro proppant. The introduction of the acid fluid can be delayed or the rate at which the dissolving material forms acid can be selected to delay the reaction to facilitate generating the micro proppant in the secondary fractures 118.

In another example, epoxy resin can be emulsified in water and provided as a proppant pre-cursor into the well bore 104 along with the fracturing fluid and/or emulsified directly in the fracturing fluid. A hardener (e.g., amine and/or another hardener) can also be emulsified in the water or fracturing fluid. The epoxy will harden downhole due to heat from the subterranean zone 102 and form micro proppant. The hardener can be selected based on its rate of reaction to delay the reaction to facilitate generating the micro proppant in the secondary fractures 118.

In certain instances, the micro proppant can be pre-formed, for example, in a manufacturing facility and provided as proppant to the fracturing fluid. The micro proppant can be organic or inorganic in nature and can be synthesized by known methods. In certain instances, organic proppant can be created by spray drying polymeric materials. In certain instances, inorganic proppant can be created in solution by precipitation and/or another method. In one example, fly ash can be used as micro proppant. Notably, the fly ash can be non-reactive or substantially non-reactive to the constituents of the downhole environment. In another example, the micro proppant can be pre-manufactured bubbles or microspheres, such as made from glass, ceramic, polymer and/or another material.

In certain instances, the fracturing fluid can contain water and natural and synthetic polymers, where the polymers are selected to deposit in the secondary fractures 118 as micro proppant to harden and behave like particles. The polymers can be tailored to act as micro proppant in the fracture after the fractures have been formed, as well as not substantially degrade with heat or moisture. In one example, the fracturing fluid can contain cellulosic whiskers.

A number of embodiments have been described. Nevertheless, it will be understood that various modifications may be made. Accordingly, other embodiments are within the scope of the following claims.

What is claimed is:

1. A method of fracturing a subterranean zone surrounding a well bore, comprising:

fracturing the subterranean zone with a fracturing fluid to form near field primary fractures and far field secondary fractures;

mixing a proppant with the fracturing fluid;

pumping the proppant into the near field primary fractures of the subterranean zone with the fracturing fluid;

propping the near field primary fractures substantially with the proppant;

pumping a micro proppant, generated in the fracturing fluid, into the far field secondary fractures of the subterranean zone with the fracturing fluid, the micro proppant smaller than the proppant; and propping the far field secondary fractures substantially with the micro proppant.

2. The method of claim 1, where fracturing the subterranean zone with the fracturing fluid comprises fracturing a low permeability zone having a permeability of 1 mD or less with the fracturing fluid.

3. The method of claim 1, where fracturing the subterranean zone with the fracturing fluid comprises fracturing a shale zone with the fracturing fluid.

4. The method of claim 1, further comprising pumping the fracturing fluid comprising the micro proppant into the well bore at a concentration equal to or less than the critical bridging concentration of the micro proppant in the subterranean zone.

5. The method of claim 1, where generating the micro proppant in the fracturing fluid comprises generating the micro proppant in the fracturing fluid in the well bore.

6. The method of claim 1, where generating the micro proppant in the fracturing fluid comprises generating the micro proppant in the fracturing fluid in the far field secondary fractures.

7. The method of claim 1, where generating the micro proppant in the fracturing fluid comprises hydrolyzing organic silicate in the fracturing fluid by changing the pH of the fracturing fluid.

8. The method of claim 1, where generating the micro proppant in the fracturing fluid comprises hydrolyzing aluminoxane in the fracturing fluid.

9. The method of claim 1, where generating the micro proppant in the fracturing fluid comprises at least one of combining CaO and $CO_2$ in an aqueous solution to form $CaCO_3$ or combining $BaCO_3$ and aqueous $H_2SO_4$ to form $BaSO_4$.

10. The method of claim 1, where generating the micro proppant in the fracturing fluid comprises heating an emulsion of monomer and cross-linker in the fracturing fluid to generate polymer particles.

11. The method of claim 1, where generating the micro proppant in the fracturing fluid comprises combining an emulsion of furfural in an aqueous solution with an acid to form furan resin particles.

12. The method of claim 1, where generating the micro proppant in the fracturing fluid comprises combining an emulsion of epoxy resin in an aqueous solution with a hardener and heating the combination to form particles.

13. The method of claim 1, where pumping the micro proppant into the far field secondary fractures of the subterranean zone comprises pumping at least one of a spray dried polymeric material, fly ash, cellulosic whiskers or manufactured glass, polymer or ceramic microspheres with the fracturing fluid into the far field secondary fractures of the subterranean zone.

14. The method of claim 1, wherein the proppant and the micro proppant are pumped into the well bore in the fracturing fluid in a single stage fracturing treatment.

15. The method of claim 1, wherein the proppant and the micro proppant are pumped into the well bore in the fracturing fluid in a multi stage fracturing treatment.

16. The method of claim 15, wherein the proppant is pumped into the well bore in the fracturing fluid in a first stage of the multi stage fracturing treatment, and the micro proppant is pumped into the well bore in the fracturing fluid in a second stage of the multi stage fracturing treatment.

17. The method of claim 1, where the micro proppant comprises micro proppant of 200 mesh or smaller.

18. The method of claim 17, where propping the far field secondary fractures substantially with the micro proppant comprises propping dendritic fractures substantially with the micro proppant.

19. The method of claim 17, wherein the proppant comprises proppant of 100 mesh or larger.

20. A well fracturing system, comprising:

a pumping system;

a fracturing fluid source coupled to the pumping system;

a proppant source coupled to the pumping system to combine with the fracturing fluid source; and a micro proppant source coupled to the pumping system to combine with the fracturing fluid source and form the micro proppant in the fracturing fluid to yield a fracturing fluid mixture comprising the proppant and the micro proppant, the micro proppant smaller than the proppant.

21. The well fracturing system of claim 20, where the micro proppant source comprises a micro proppant pre-cursor source comprising a composition that generates a micro proppant of 200 mesh or smaller after being combined with the fracturing fluid source.

22. The well fracturing system of claim 21, where the micro proppant source further comprises an activator source comprising an activator that activates the micro proppant pre-cursor to generate the micro proppant.

23. A method, comprising:

fracturing a low permeability subterranean zone around a well bore with a fracturing fluid to generate primary fractures that extend from the wellbore and dendritic fractures that extend from the primary fractures;

combining a micro proppant pre-cursor with an activator to generate, in the fracturing fluid, a micro proppant of 200 mesh or smaller; and propping the primary fractures substantially with a proppant of 100 mesh or larger that is mixed into the fracturing fluid at a terranean surface;

propping the dendritic fractures substantially with the micro proppant.

24. The method of claim 23, where the low permeability subterranean zone has a permeability of 1 mD or less.

25. The method of claim 23, where combining a proppant pre-cursor with an activator to generate a micro proppant of 200 mesh or smaller comprises combining the proppant pre-cursor with the activator to generate the micro proppant in the well bore.

26. A method of fracturing a subterranean zone surrounding a well bore, comprising:

fracturing the subterranean zone with a fracturing fluid to form near field primary fractures and far field secondary fractures;

pumping proppant into far field fractures of the subterranean zone, the proppant comprising substantially micro proppant;

generating the micro proppant in the fracturing fluid by hydrolyzing aluminoxane in the fracturing fluid; and propping far field fractures substantially with the micro proppant.

* * * * *